US008931918B2

(12) United States Patent
Liu et al.

(10) Patent No.: US 8,931,918 B2
(45) Date of Patent: Jan. 13, 2015

(54) LAMP TUBE CONNECTOR STRUCTURE FOR LIGHT EMITTING DIODE (LED) LAMP TUBE

(75) Inventors: Chun-Chen Liu, Jhubei (TW); Hsiao-Lan Chin, Jhubei (TW)

(73) Assignee: Verticil Electronics Corporation, Hsinchu County (TW)

( * ) Notice: Subject to any disclaimer, the term of this patent is extended or adjusted under 35 U.S.C. 154(b) by 148 days.

(21) Appl. No.: 13/597,891

(22) Filed: Aug. 29, 2012

(65) Prior Publication Data

US 2013/0215609 A1 Aug. 22, 2013

(30) Foreign Application Priority Data

Feb. 17, 2012 (TW) ..... 101202898 U

(51) Int. Cl.
*F21S 4/00* (2006.01)

(52) U.S. Cl.
USPC ..... 362/223; 362/240

(58) Field of Classification Search
USPC ..... 362/223, 240, 221
See application file for complete search history.

(56) References Cited

U.S. PATENT DOCUMENTS

2010/0124054 A1* 5/2010 Chen et al. ..... 362/221

* cited by examiner

*Primary Examiner* — Anne Hines
(74) *Attorney, Agent, or Firm* — Ming Chow; Sinorica, LLC

(57) ABSTRACT

An improved lamp tube connector structure for light emitting diode (LED) lamp tube, in which the LED lamp tube comprises a lampshade, two lamp tube connectors installed on the left and right ends of the lampshade, at least an LED lamp strap installed inside the lampshade, and at least a drive circuit board installed inside the lamp tube connector and electrically connected to either side of the LED lamp strap. Herein the lamp tube connector is an end cap, with two electrode terminals extending outward from the end cap. Also, at least two connection lines extend from the drive circuit board, and the drive circuit board is inserted to the interior of the electrode terminal so as to form an electrically conductive contact with the electrode terminal for transferring electric power.

2 Claims, 11 Drawing Sheets

LAMP TUBE CONNECTOR STRUCTURE FOR LIGHT EMITTING DIODE (LED) LAMP TUBE

The current application claims a foreign priority to the patent application of Taiwan No. 101202898 filed on Feb. 17, 2012.

BACKGROUND OF THE INVENTION

1. Field of the Invention

The present invention generally relates to an improved lamp tube connector structure for light emitting diode (LED) lamp tube; in particular, the present invention relates to a lamp tube connector structure allowing a fixed length of the connection line electrically connecting the interior of the lamp tube connector to the drive circuit board.

2. Description of Related Art

Featuring many advantages such as better power saving, longer life span, smaller size and faster reaction speed or the like, light emitting diodes (LEDs) are at present comprehensively applied in various illumination fields. Now certain manufacturers have developed the LED lamp tube allowable for replacement of fluorescent lamps. In a conventional LED lamp tube 1, as shown in FIGS. 1 and 2, two LED lamp straps 12 are installed respectively on the left and right sides of a long-strapped lampshade 11. Moreover, a lamp tube connector is respectively installed on the left and right sides of the long-strapped lampshade 11, in which the lamp tube connector is an end cap 13, and a drive circuit board 131 connected to the LED lamp strap 12 is installed inside the end cap 13 in order to drive the LED lamp strap 12 for light emissions.

Additionally, two electrode terminals 132, 134 penetrate to the exterior of the end cap 13 from the interior of the end cap 13, and the conductive ends 133, 135 of the electrode terminals 132, 134 are individually located inside the end cap 13. Therefore, using at least two connection lines 14, one end of the connection line 14 is soldered onto the drive circuit board 131, and the other end thereof is jointed to the conductive ends 133, 135 inside the end cap 13, such that the electrode terminals 132, 134 can electrically contact the drive circuit board 131 to transfer electric power.

However, with regards to the aforementioned circuit layout, since the other end of the connection line 14 needs to be soldered onto the conductive end 133, 135 inside the end cap 13 to allow assembly operations, such a soldering process has to be performed under a situation where the end cap 13 and the long-strapped lampshade 11 are separate. Unfortunately, the area of the end cap 13 is usually relatively small, so, suppose the other end of the connection line 14 needs to be soldered onto the conductive end 133, 135 inside the end cap 13, precise and prudent operations are required to obtain the desired accurate soldering results in order to ensure the electrical conductivity.

Since the assembly operation has not yet been completed before soldering processes, the length of the connection line 14 connecting between the conductive end 133, 135 and the drive circuit board 131 may not be consistent to the standard specification (in other word, the connection line 14 needs to be sufficiently long, thus allowing operators to reach the interior of the end cap 13 to solder the connection line). Upon completion of assembly operation, as shown in FIGS. 1 and 2, the connection line 14 placed therein will definitely become too long, which may undesirably cause bending or entanglement problems of the two connection lines 14. On the other hand, in case the connection line 14 becomes overly short, the electrical connection may not be successfully achieved and the operator can not reach the inside of the end cap 13 to perform soldering processes.

Consequently, the length of the connection line 14 becomes an annoying issue for manufacturers. In addition to the aforementioned problems, excessive length of the connection line 14 may further result in circuit interference or inconvenience in assembly operations.

Therefore, it would be an optimal solution if it is possible to allow a fixed length of the connection line electrically connecting the interior of the lamp tube connector to the drive circuit board, and also further enables electrical conductivity between the connection line and the electrode terminal without soldering processes.

SUMMARY OF THE INVENTION

The present invention provides a lamp tube connector structure allowing a fixed length of the connection line electrically connecting the interior of the lamp tube connector to the drive circuit board.

The present invention also provides a lamp tube connector structure enabling electrical conductivity between the connection line and the electrode terminal without soldering processes on the connection line and the electrode terminal.

An improved lamp tube connector structure for light emitting diode (LED) lamp tube capable of achieving the aforementioned objectives is herein disclosed, in which the LED lamp tube comprises a lampshade, two lamp tube connectors installed on the left and right ends of the lampshade, at least an LED lamp strap installed inside the lampshade, and at least a drive circuit board installed inside the lamp tube connector and electrically connected to either side of the LED lamp strap, characterized in that: the lamp tube connector is an end cap, with two electrode terminals extending outward from the end cap, and at least two connection lines extend from the drive circuit board, and the drive circuit board is inserted to the inside of the electrode terminal so as to be in electrically conductive contact with the electrode terminal to transfer electric power.

More specifically, an end of the aforementioned end cap toward the lampshade has an opening for cap installation onto an end of the lampshade; and the other end of the end cap has two holes and the two electrode terminals extend outward through these two holes.

More specifically, the interior of the aforementioned electrode terminal is of a hollow structure, and the connection line can extend to the two holes from the drive circuit board for insertion to the inside of the two electrode terminals and form an electrically conductive contact with such two electrode terminals for transferring electric power.

More specifically, the aforementioned lamp tube connector located on either side of the LED lamp strap which is not in electrically conductive contact with the drive circuit board does not transfer electric power to the LED lamp strap.

More specifically, the aforementioned LED lamp strap includes a plurality of LEDs.

More specifically, the aforementioned lampshade is of a long-strapped shape.

In addition to the above-said structure, it is also possible to apply another structure to achieve the same objective, in which such a structure comprises an end cap, with two electrode terminals extending outward from the end cap, and the drive circuit board has a fixation base which is electrically connected to the inside of the electrode terminal by means of two connection lines, such that electric power can be conducted to the fixation base by the electrode terminal and the drive circuit board receives the transferred electric power through the fixation base.

More specifically, an end of the aforementioned end cap toward the lampshade has an opening for cap installation onto an end of the lampshade; and the other end of the end cap has two holes and the two electrode terminals extend outward through these two holes; also, an end of the fixation base toward the end cap has two openings.

More specifically, the interior of the aforementioned electrode terminal is of a hollow structure, so that the connection line can extend toward the two holes of the end cap through the two openings of the fixation base and be inserted to the interior of the electrode terminal in order to form an electrically conductive contact with the electrode terminal for transferring electric power.

More specifically, the interior of the aforementioned electrode terminal is of a hollow structure, so that the connection line can extend toward the two openings of the fixation base through the interior of the electrode terminal and be inserted to the interior of the two openings of the fixation base in order to form an electrically conductive contact with the fixation base for transferring electric power.

More specifically, the aforementioned lamp tube connector located on either side of the LED lamp strap which is not in electrically conductive contact with the drive circuit board does not transfer electric power to the LED lamp strap.

More specifically, the aforementioned LED lamp strap includes a plurality of LEDs.

More specifically, the aforementioned lampshade is of a long-strapped shape.

Furthermore, in addition to the above-said two types of structure, it is also possible to allow the two connection lines to be integrally formed on the end cap, and the drive circuit board has a fixation base which can be electrically connected to the two connection lines, such that electric power can be conducted to the fixation base by means of the connection lines and the drive circuit board receives the transferred electric power through the fixation base.

More specifically, an end of the aforementioned end cap toward the lampshade has an opening for cap installation onto an end of the lampshade, and an end of the fixation base toward the end cap has two openings. Meanwhile, an end of the connection line extends outward from the outside of the other end of the end cap, and the other end of the connection line extends toward the two openings of the fixation base and is inserted to the interior of the two openings, thereby forming an electrically conductive contact with the fixation base for transferring electric power.

More specifically, the aforementioned lamp tube connector located on either side of the LED lamp strap which is not in electrically conductive contact with the drive circuit board does not transfer electric power to the LED lamp strap.

More specifically, the aforementioned LED lamp strap includes a plurality of LEDs.

More specifically, the aforementioned lampshade is of a long-strapped shape.

DETAILED DESCRIPTION OF THE PREFERRED EMBODIMENTS

The aforementioned and other technical contents, aspects and effects in relation with the present invention can be clearly appreciated through the detailed descriptions concerning the preferred embodiments of the present invention in conjunction with the appended drawings.

Figure 1:
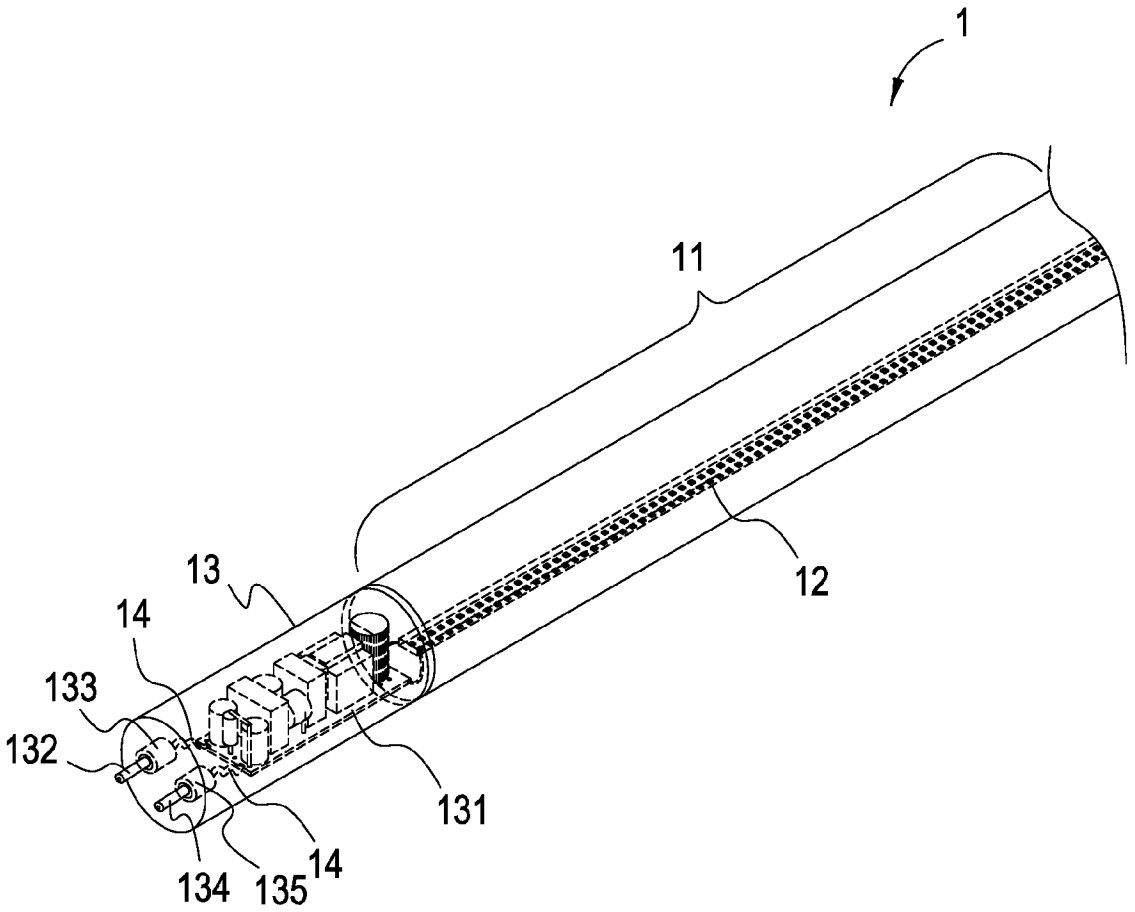
FIG. 1 shows a stereo structural diagram for the lamp tube connector structure of a conventional LED lamp tube.
Figure 2:
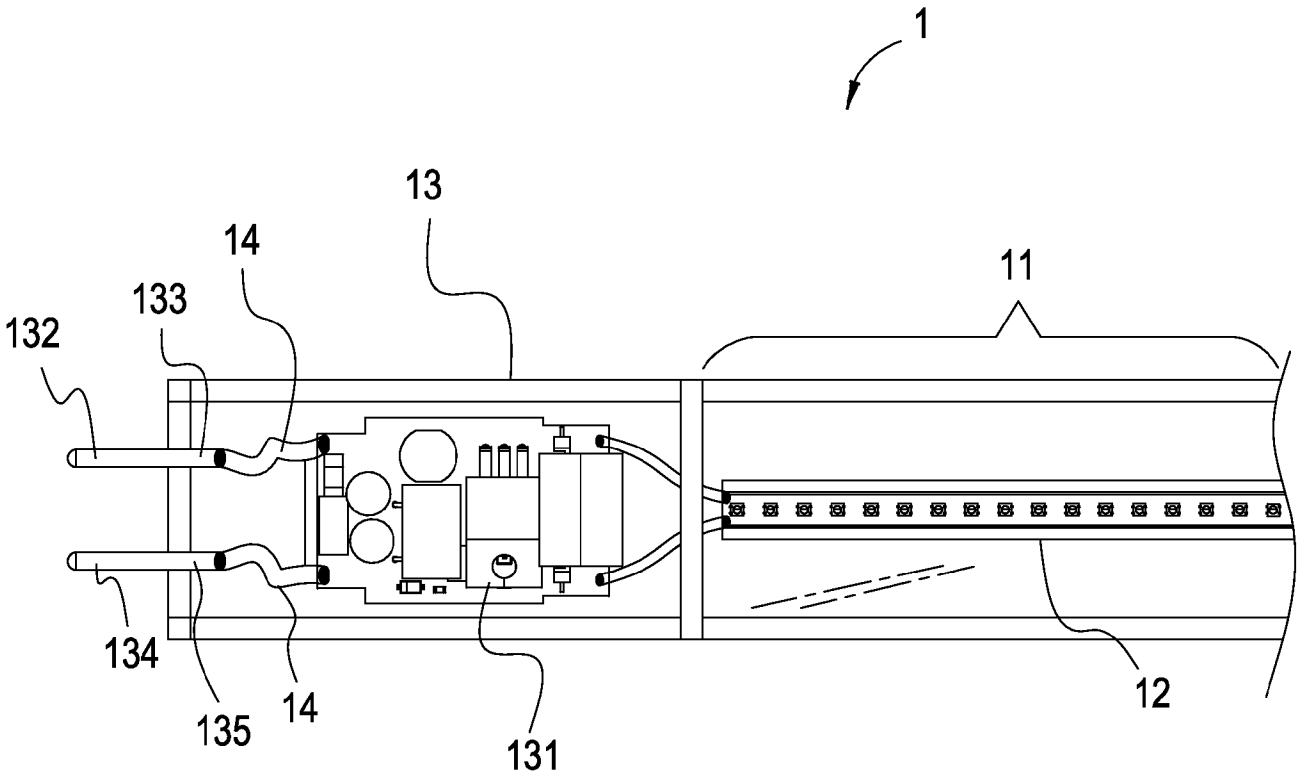
FIG. 2 shows a structural top view for the lamp tube connector structure of a conventional LED lamp tube.
Figure 3:
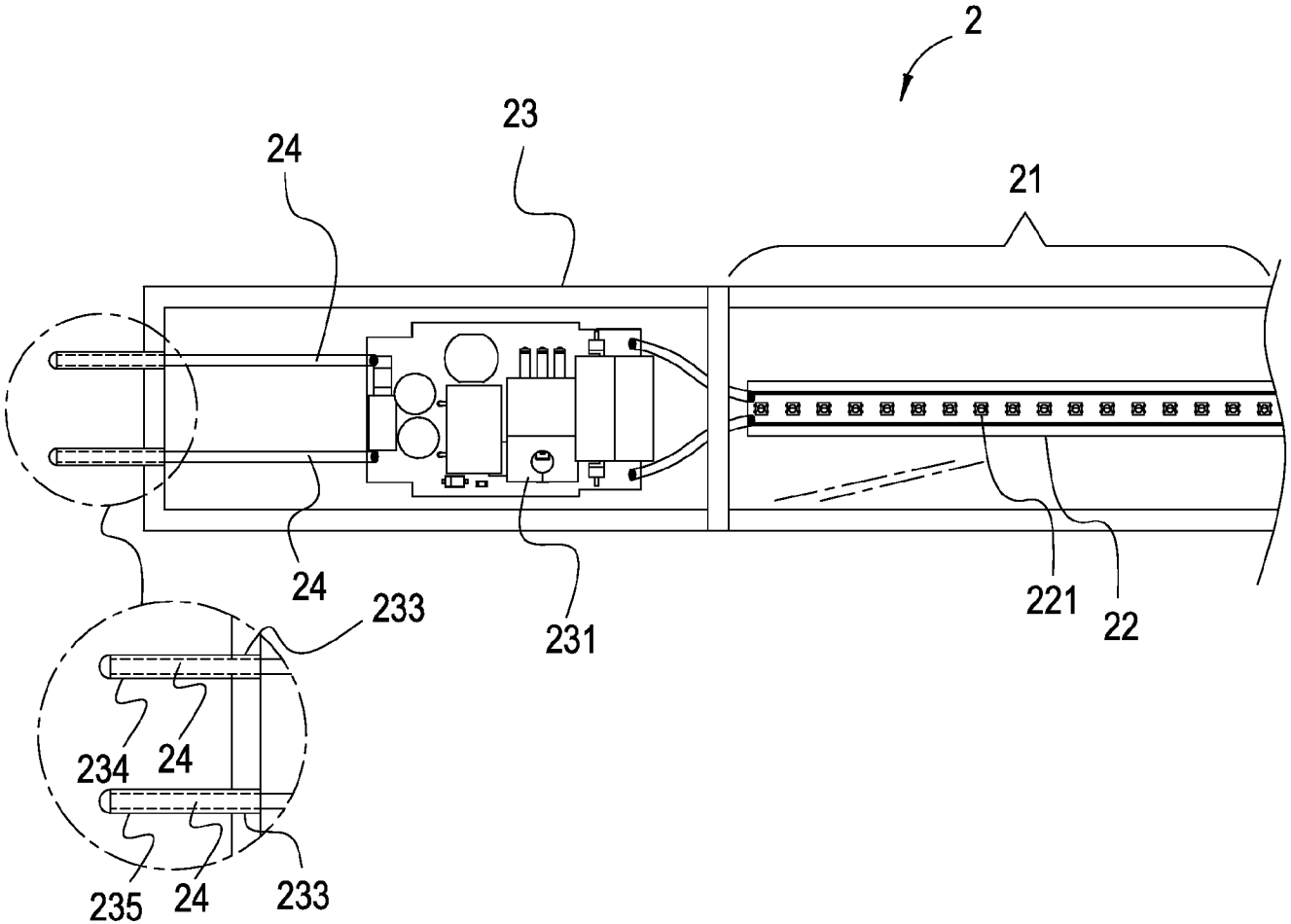
FIG. 3 shows a structural top view for a first embodiment of the improved lamp tube connector structure for LED lamp tube according to the present invention.

Refer first to FIG. 3, wherein a structural top view for a first embodiment of the improved lamp tube connector structure for LED lamp tube according to the present invention is shown. From the Figure, it can be seen that the LED lamp tube 2 comprises a lampshade 21, two lamp tube connectors installed on the left and right ends of the lampshade 21 (said lamp tube connector in the present embodiment is illustrated as the end cap 23), at least an LED lamp strap 22 installed inside the lampshade 21 (in which the LED lamp strap 22 includes a plurality of LEDs 221), and at least a drive circuit board 231 installed inside the lamp tube connector and electrically connected to either side of the LED lamp strap 22.

Figure 4:
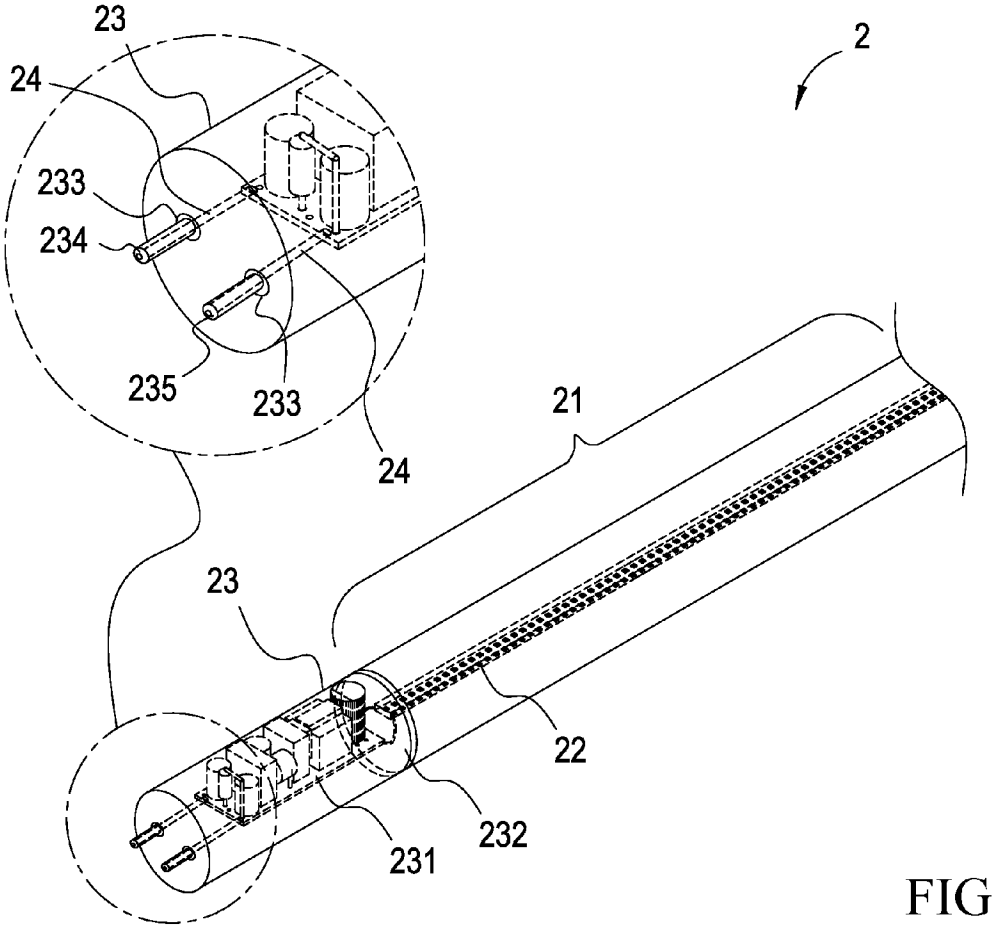
FIG. 4 shows a stereo structural diagram for the first embodiment of the improved lamp tube connector structure for LED lamp tube according to the present invention.

Also, from FIGS. 3 and 4, it can be seen that the lamp tube connector is an end cap 23 which has an opening 232 on an end thereof toward the lampshade 21 for cap installation onto an end of the lampshade 21. Meanwhile, the other end of the end cap 23 has two holes 233, and two electrode terminals 234, 235 extend outward through these two holes 233. Hence, for the drive circuit board, an end of the connection line 24 can be soldered in connection to the drive circuit board 231 by means of the at least two connection lines 24. Since the interior of the electrode terminals 234, 235 is of a hollow structure, upon cap installing the end cap 23 onto an end of the lampshade 21, the other end of the connection line 24 can extend to the two holes 233 and be inserted to the interior of the electrode terminal 234, 235 in order to form an electrically conductive contact with the electrode terminal 234, 235 for transferring electric power to the drive circuit board 231 and the LED lamp strap 22 by way of the electrode terminal 234, 235.

In the present embodiment, only the configuration on one end is shown, because the technical contents of the present invention indeed apply no matter two separate LED lamp tubes or otherwise a single LED lamp tube is installed inside the lampshade.

As a result, in case that two separate LED lamp tubes (not shown) are set inside the lampshade, it is necessary to respectively install a drive circuit board in the end cap on both the left and right sides of these two separate LED lamp tubes and allow electric power to be conducted to the drive circuit board and the LED lamp strap through the electrode terminal of the end cap, such that the drive circuit board can drive the LED lamp tube.

On the other hand, should there be only a single LED lamp tube (not shown) inside the lampshade, the electrode terminal of the end cap on one end can still transfer electric power to the drive circuit board and the LED lamp strap such that the drive circuit board can drive the LED lamp tube; however, since the end cap on the other side is not connected to the drive circuit board, it is not required to transfer electric power to the drive circuit board.

Figure 5:
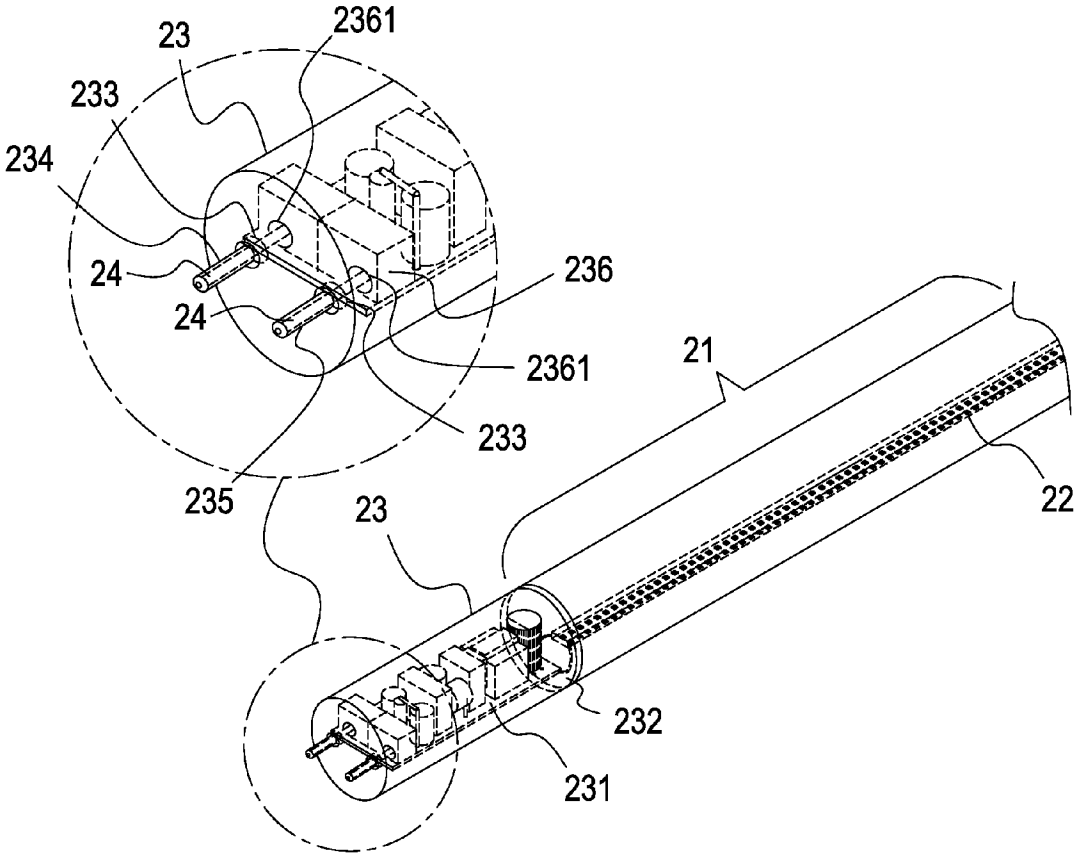
FIG. 5 shows a stereo structural diagram for a second embodiment and a third embodiment of the improved lamp tube connector structure for LED lamp tube according to the present invention.

Except the structure described in the first embodiment, it is also possible to apply another structure to achieve the same objective. As shown in FIG. 5, an end of the end cap 23 toward the lampshade 21 has an opening 232 for cap installation onto an end of the lampshade 21, and the other end of the end cap 23 has two holes 233 and two electrode terminals 234, 235 extend outward through the two holes 233 of the end cap 23. Moreover, the drive circuit board 231 includes a fixation base 236, in which the fixation base 236 is electrically connected to the interior of the electrode terminals 234, 235 so that the drive circuit board 231 can receive the electric power transferred by the electrode terminals 234, 235 through the fixation base 236.

Figure 6A:
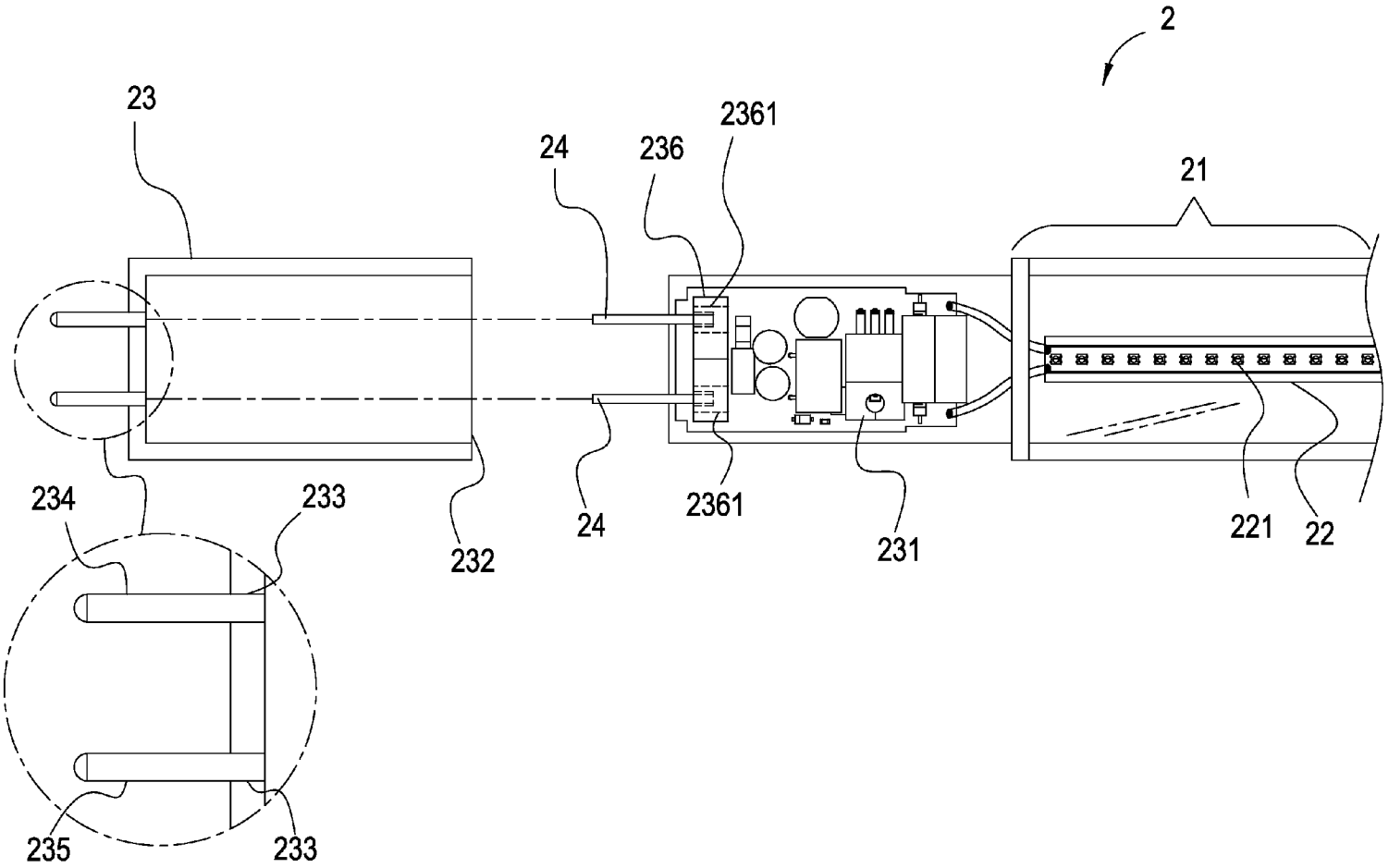
FIG. 6A shows a structural disassembled top view for the second embodiment of the improved lamp tube connector structure for LED lamp tube according to the present invention.
Figure 6B:
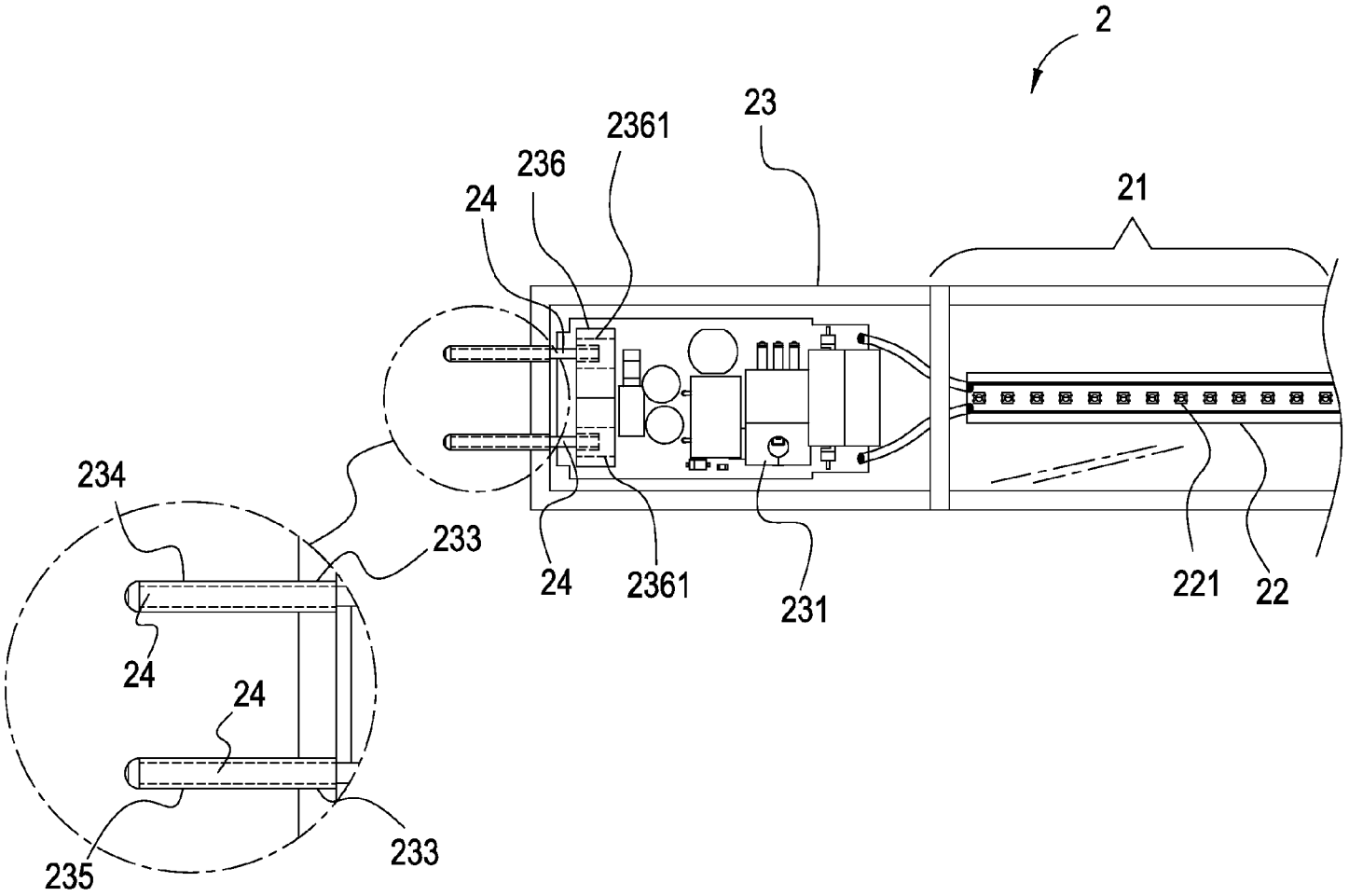
FIG. 6B shows a structural assembled top view for the second embodiment of the improved lamp tube connector structure for LED lamp tube according to the present invention.

At least two types of connection between the fixation base 236 and the connection line 24 are applicable, one of which is shown in FIGS. 6A and 6B. Because the interior of the electrode terminal 234, 235 is of a hollow structure and the connection line 24 extends from the two openings 2361 of the fixation base 236, upon cap installing the end cap 23 onto an end of the lampshade 21, the connection line 24 can extend to the two holes 233 and be inserted to the interior of the electrode terminal 234, 235 so as to form an electrically conductive contact with the electrode terminal 234, 235 for conducting electric power.

Figure 7A:
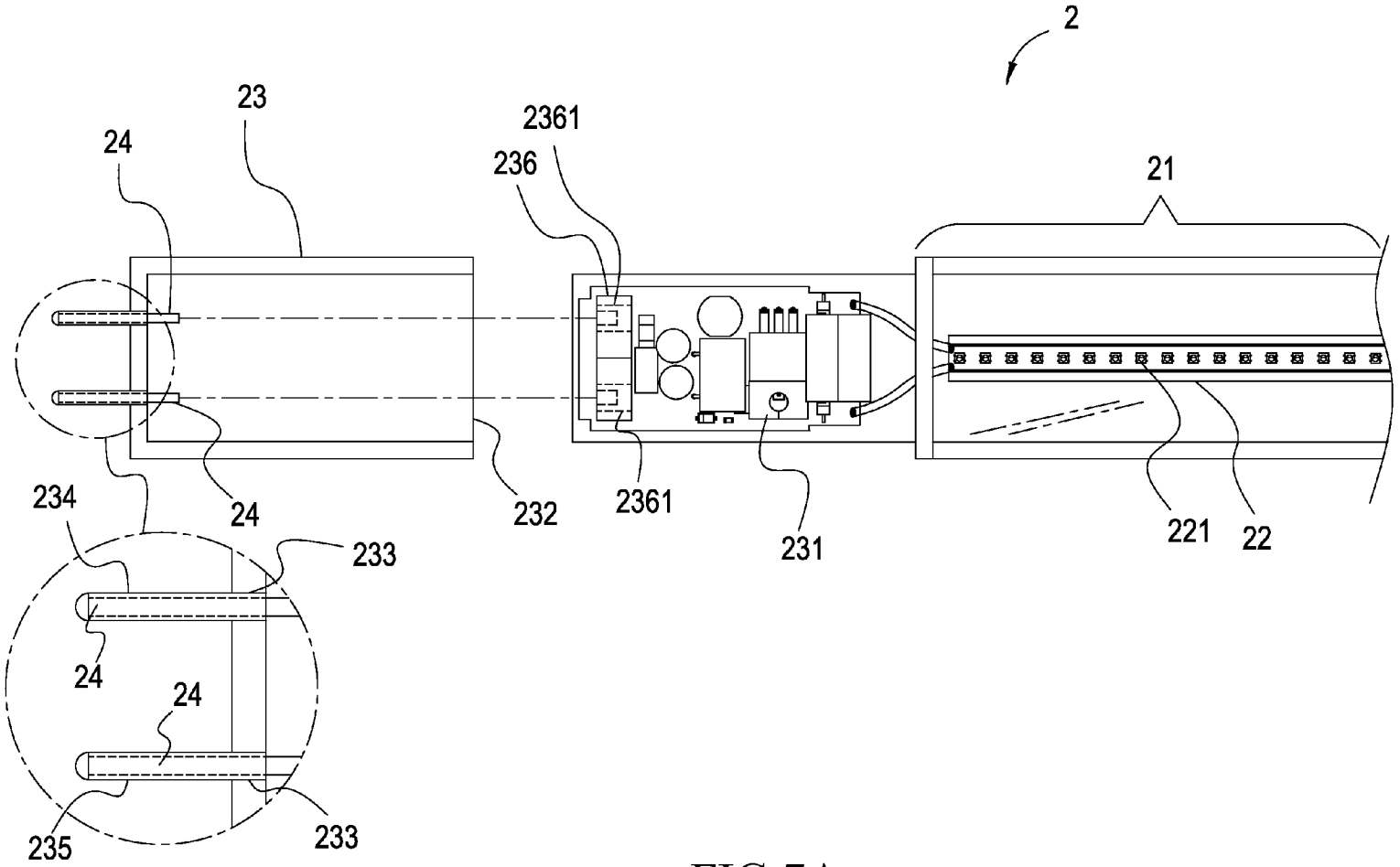
FIG. 7A shows a structural disassembled top view for the third embodiment of the improved lamp tube connector structure for LED lamp tube according to the present invention.
Figure 7B:
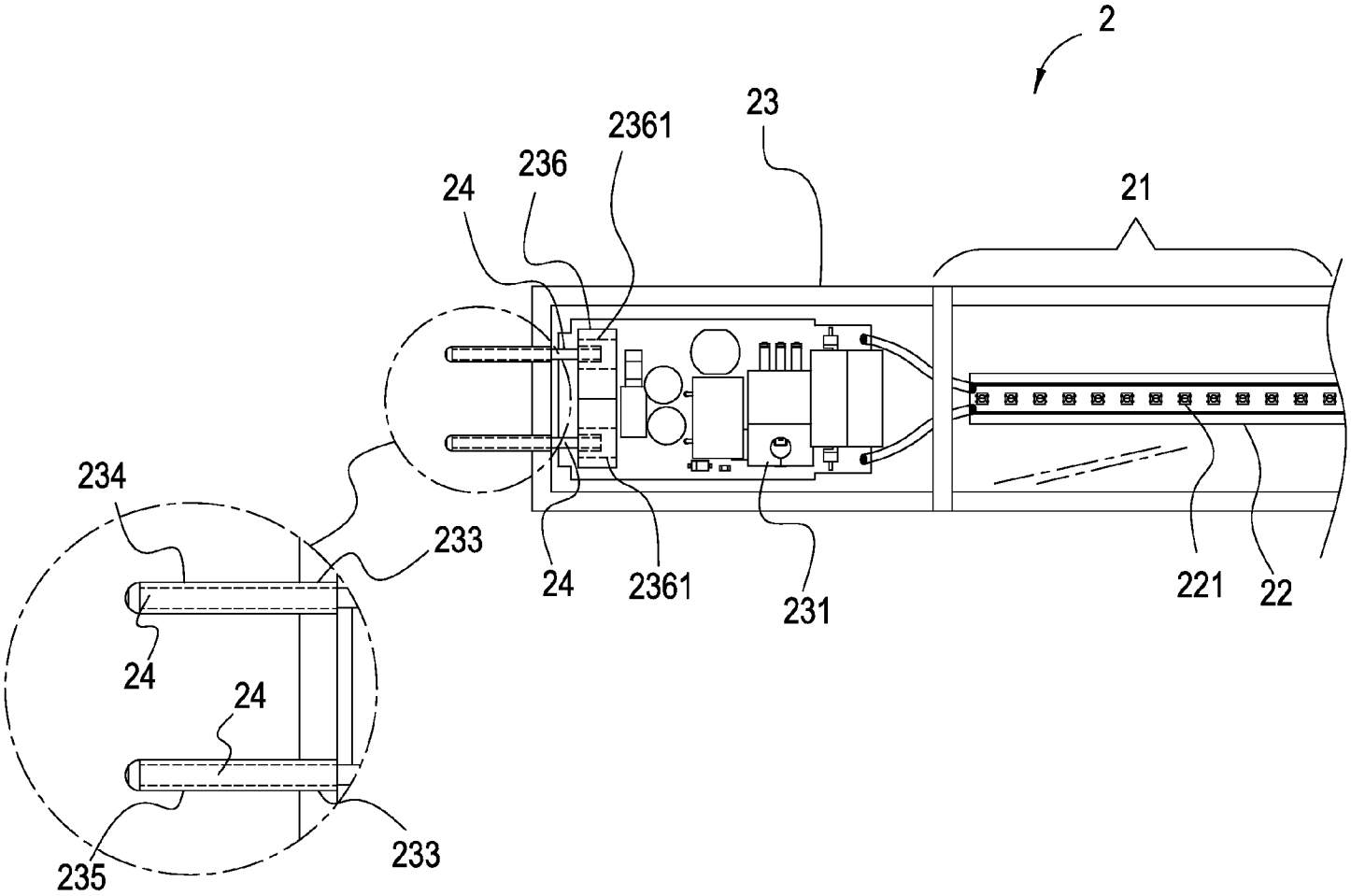
FIG. 7B shows a structural assembled top view for the third embodiment of the improved lamp tube connector structure for LED lamp tube according to the present invention.

Another connection configuration thereof can be shown in FIGS. 7A and 7B. Again, the interior of the electrode terminal 234, 235 is of a hollow structure, but the connection line 24 extends toward the two openings 2361 of the fixation base 236 from the interior of the electrode terminal 234, 235, so that, upon cap installing the end cap 23 onto an end of the lampshade 21, the connection line 24 can be inserted to the interior of two openings 2361 of the fixation base 236 thereby forming an electrically conductive contact with the fixation base 236 for conducting electric power. Besides, as previously described in the first embodiment, in case that two separate LED lamp tubes (not shown) are set inside the lampshade, it is necessary to respectively install a drive circuit board in the end cap on both the left and right sides of these two separate LED lamp tubes and allow electric power to be conducted to the drive circuit board and the LED lamp strap through the electrode terminal of the end cap, such that the drive circuit board can drive the LED lamp tube.

Whereas if there is only a single LED lamp tube (not shown) inside the lampshade, the electrode terminal of the end cap on one end can still transfer electric power to the drive circuit board and the LED lamp strap such that the drive circuit board can drive the LED lamp tube; however, since the end cap on the other side is not connected to the drive circuit board, it is not required to transfer electric power to the drive circuit board.

Figure 8A:
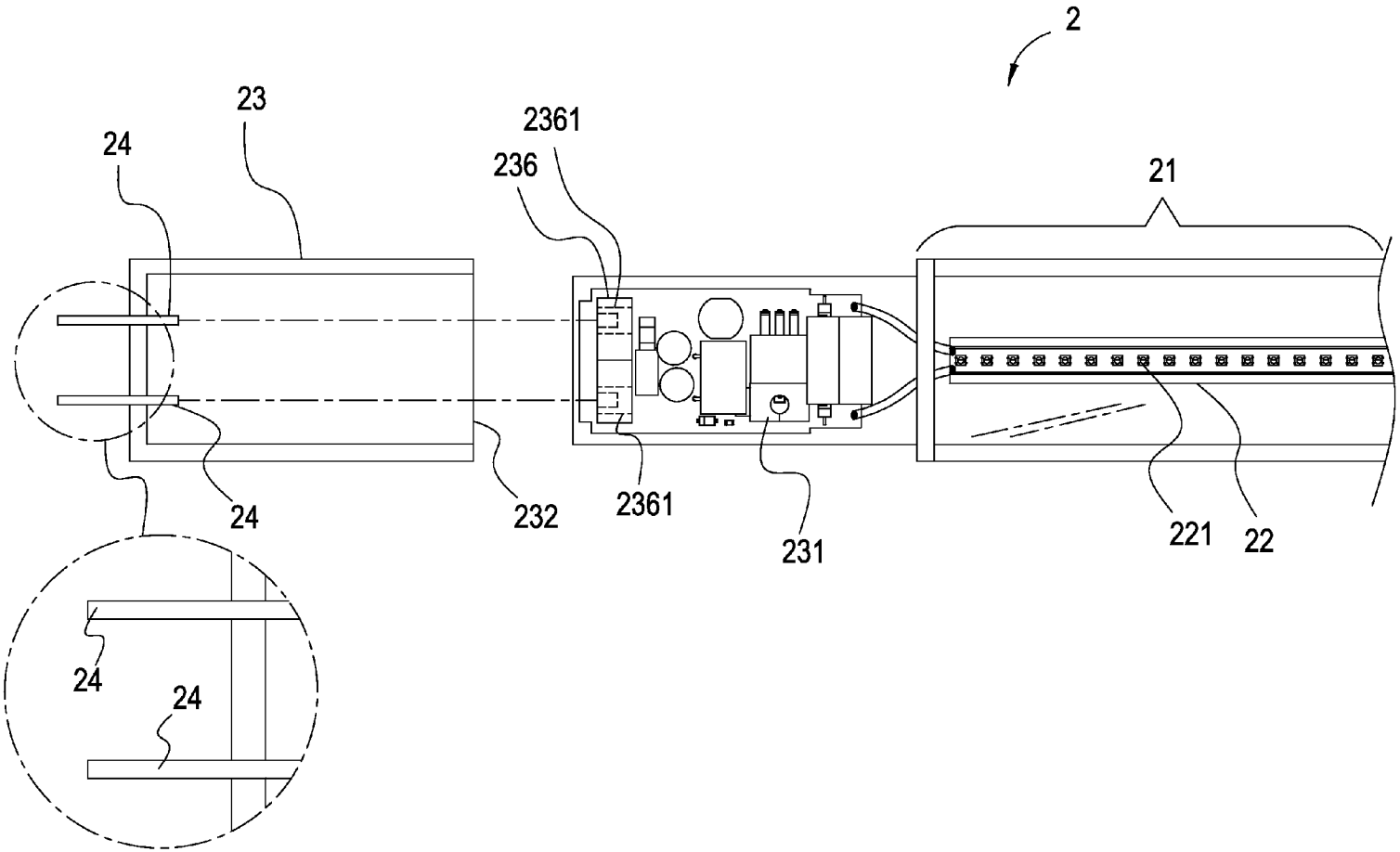
FIG. 8A shows a structural disassembled top view for a fourth embodiment of the improved lamp tube connector structure for LED lamp tube according to the present invention.
Figure 8B:
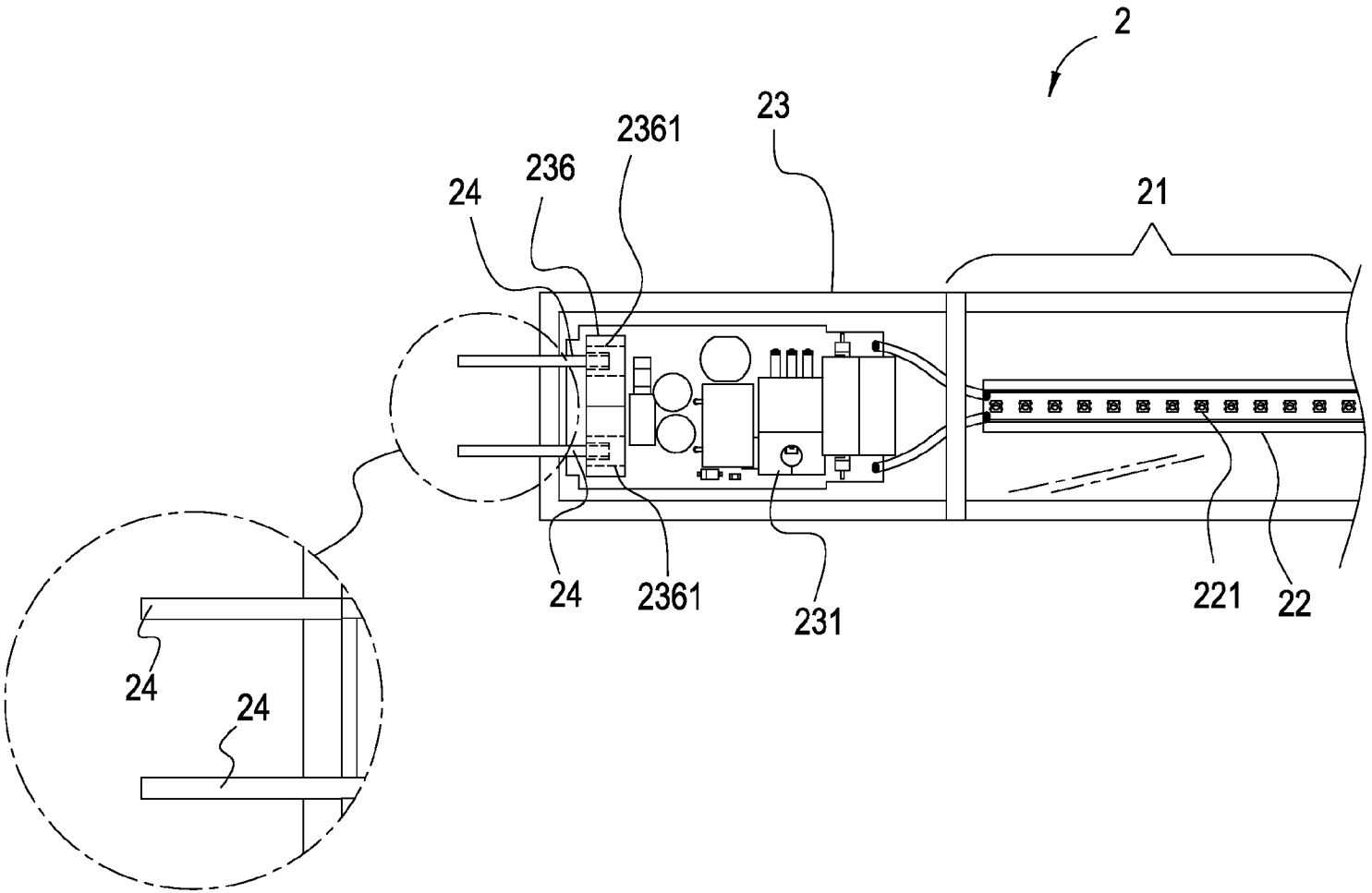
FIG. 8B shows a structural assembled top view for the fourth embodiment of the improved lamp tube connector structure for LED lamp tube according to the present invention.

Furthermore, with regards to the second embodiment, this type of structure needs one more step to place the connection line 24 into the interior of the electrode terminal 234, 235 during actual manufacture processes, so yet another embodiment approach may apply. As shown in FIGS. 8A and 8B, the connection line 24 can be integrally formed onto the end cap 23, with one end of the connection line 24 extending outward from the end cap 23 and the other end thereof extending toward the two openings 2361 of the fixation base 236. In this way, upon cap installing the end cap 23 onto an end of the lampshade 21, the connection line 24 can be inserted to the interior of the two openings 2361 of the fixation base 236 in order to form an electrically conductive contact with the fixation base 236 for transferring electric power.

Compared with other conventional technologies, the improved lamp tube connector structure for LED lamp tube provided by the present invention further offers the following advantages:

1. The present invention allows a fixed length of the connection line electrically connecting the interior of the lamp tube connector to the drive circuit board, and also further enables electrical conductivity between the connection line and the electrode terminal without soldering processes.

2. The present invention allows a fixed length of the connection line, and after completion of assembly operations, it is possible to make the connection line in electrically conductive contact with the electrode terminal such that the issue concerning the connection line of excessive length can be totally resolved.

By way of the aforementioned detailed descriptions for the preferred embodiments according to the present invention, it is intended to better illustrate the characters and spirit of the present invention rather than restricting the scope of the present invention to the preferred embodiments disclosed in the previous texts. Contrarily, the objective is to encompass all changes and effectively equivalent arrangements within the scope of the present invention as delineated in the following claims of the present application.

What is claimed is:

1. An improved lamp tube connector structure for light emitting diode (LED) lamp tube, in which the LED lamp tube comprises a lampshade, two lamp tube connectors installed on the left and right ends of the lampshade respectively, at least one LED lamp strap installed inside the lampshade, and at least a drive circuit board installed inside either side of the lamp tube connector and electrically connected to either side of the LED lamp strap, characterized in that: the lamp tube connector is an end cap, with two electrode terminals extending outward from the end cap, and the drive circuit board has a fixation base which is electrically connected to the inside of the electrode terminal by means of two connection lines, such that electric power can be conducted to the fixation base by the electrode terminal and the drive circuit board receives the transferred electric power through the fixation base;

an end of the end cap toward the lampshade has an opening for cap installation onto an end of the lampshade;

the other end of the end cap has two holes and the two electrode terminals extend outward through these two holes;

an end of the fixation base toward the end cap has two openings;

the interior of the electrode terminal is of a hollow structure, so that the connection line can extend toward the two holes of the end cap through the two openings of the fixation base and be inserted to the interior of the electrode terminal in order to form an electrically conductive contact with the electrode terminal for transferring electric power;

the lamp tube connector located on either side of the LED lamp strap which is not in electrically conductive contact with the drive circuit board does not transfer electric power to the LED lamp strap;

the LED lamp strap includes a plurality of LEDs; and the lampshade is of a long-strapped shape.

2. An improved lamp tube connector structure for light emitting diode (LED) lamp tube, in which the LED lamp tube comprises a lampshade, two lamp tube connectors installed on the left and right ends of the lampshade respectively, at least one LED lamp strap installed inside the lampshade, and at least a drive circuit board installed inside either side of the lamp tube connector and electrically connected to either side of the LED lamp strap, characterized in that: the lamp tube connector is an end cap, with two electrode terminals extending outward from the end cap, and the drive circuit board has a fixation base which is electrically connected to the inside of the electrode terminal by means of two connection lines, such that electric power can be conducted to the fixation base by the electrode terminal and the drive circuit board receives the transferred electric power through the fixation base;

an end of the end cap toward the lampshade has an opening for cap installation onto an end of the lampshade;

the other end of the end cap has two holes and the two electrode terminals extend outward through these two holes;

an end of the fixation base toward the end cap has two openings;

the interior of the electrode terminal is of a hollow structure, so that the connection line can extend toward the two openings of the fixation base through the interior of the electrode terminal and be inserted to the interior of the two openings of the fixation base in order to form an electrically conductive contact with the fixation base for transferring electric power;

the lamp tube connector located on either side of the LED lamp strap which is not in electrically conductive contact with the drive circuit board does not transfer electric power to the LED lamp strap;

the LED lamp strap includes a plurality of LEDs; and the lampshade is of a long-strapped shape.

* * * * *